US005587779A

United States Patent [19]

Heeren et al.

[11] Patent Number: 5,587,779

[45] Date of Patent: Dec. 24, 1996

[54] APPARATUS FOR TRANSFERRING TONER IMAGES

[75] Inventors: Theodorus A. G. Heeren; Edwin J. Buis, both of Venlo, Netherlands

[73] Assignee: Oce-Nederland, B.V., MA Venlo, Netherlands

[21] Appl. No.: 501,183

[22] Filed: Jul. 11, 1995

[30] Foreign Application Priority Data

Aug. 22, 1994 [NL] Netherlands ..... 9401352

[51] Int. Cl.[6] ..... G03G 15/16

[52] U.S. Cl. ..... 355/271; 347/154; 355/277; 355/279

[58] Field of Search ..... 355/277, 279, 355/271; 347/154, 156

[56] References Cited

U.S. PATENT DOCUMENTS

| | | | |
|---|---|---|---|
| 4,556,309 | 12/1985 | Weber et al. | 355/271 |
| 4,845,519 | 7/1989 | Fuse | 347/112 |
| 4,894,686 | 1/1990 | Bujese | 355/271 |
| 5,142,338 | 8/1992 | Malinaric et al. | 355/271 |

FOREIGN PATENT DOCUMENTS 0466127 1/1992 European Pat. Off. .

OTHER PUBLICATIONS

Bock, Edward C., "Photoreceptor Vacuum Drive", *Xerox Disclosure Journal,* vol. 9, No. 1, 1984, p. 31.

*Primary Examiner*—Arthur T. Grimley
*Assistant Examiner*—Sophia S. Chen
*Attorney, Agent, or Firm*—Birch, Stewart, Kolasch & Birch, LLP

[57] ABSTRACT

An apparatus is provided for transferring a toner image from an endless belt to a receiving material positioned on a flat plate. The toner image is formed by image-forming drums on a part of the belt movable continuously along the drums and is transferred to the receiving material, starting at the leading edge of the toner image and ending at the trailing edge of the toner image. For allowing the latter, an increasable loop is formed in the belt before the image-transfer station and a reducible loop is formed in the belt after the image-transfer station. The loops in the belt are held taut by moving tension rollers in planes forming an acute angle α with the flat plate, whereby at the image-transfer station the belt forms a constant angle β with the flat plate.

14 Claims, 5 Drawing Sheets

APPARATUS FOR TRANSFERRING TONER IMAGES

BACKGROUND OF THE INVENTION

1. Field of the Invention

This invention relates to an imaging system, and more specifically to an apparatus for transferring a toner image from an endless intermediate medium to a receiving material.

2. Discussion of Related Art

An apparatus for transferring toner images is known from U.S. Pat. No. 4,845,519, wherein there is described an apparatus in which the endless intermediate medium is trained solely around two rollers situated at fixed distances from one another, the image-forming station being formed by one of the taut parts of the medium between the two rollers and the image-transfer station being formed by the other taut part of the intermediate medium, between the two rollers. For toner image transfer to a stationary strip of receiving material at the image-transfer station, the entire endless intermediate medium must be stopped for the period during which the toner image transfer takes place. During this period of stoppage of the intermediate medium, a latent image is formed or placed on the intermediate medium at the image-forming station. Between two successive periods during which toner image transfer takes place, that part of the intermediate medium on which the latent image has been formed moves from the image-forming station to the image-transfer station, during which movement the latent image is developed with toner by means of a developing roller disposed next to the intermediate medium. Since development necessarily takes place at a relatively slow speed, the number of images that can be printed per unit of time with this known apparatus is limited.

SUMMARY OF THE INVENTION

Therefore, it is an object of the present invention to provide an imaging system which will overcome the above-noted disadvantages.

A further object of the present invention is to provide a novel apparatus for transferring toner developed images.

Still, a further object of the present invention is to provide a novel system for transferring toner in an imagewise configuration from an intermediate medium to a stationary medium at an image transfer station.

The foregoing objects and other are accomplished in accordance with the present invention, generally speaking, by providing an apparatus for transferring a toner image from an endless intermediate medium, which is adapted to be advanced in one direction, to a receiving material, the toner image being formed by at least one image-forming element on the intermediate medium at an image-forming station and transferred to a stationary strip of receiving material at an image-transfer station. The intermediate medium is continuously movable at the image-forming station and loop-forming means are provided between the image-forming station and the image-transfer station and between the image-transfer station and the image-forming station for periodically enabling stoppage of the advance of the intermediate medium at the image-transfer station.

Consequently, to form the toner image on the intermediate medium the image-forming element can be disposed at a fixed place near the intermediate medium and the formation of consecutive images can be carried out on a continuously moving endless intermediate medium, while the transfer of these images from a non-advancing, stationary part of the intermediate medium can still take place with the formation of a loop in front of the stationary part and removal of a loop after the stationary part. The stationary part of the intermediate medium can be advanced very rapidly between the transfer of successive toner images, with a loop being formed after the stationary part and removal of the loop before the stationary part, because during such movement no image-forming actions need to be performed on the stationary portion of the intermediate medium. This results in an apparatus of rapid operation without a rapid-operating developing station being required.

In one advantageous embodiment of the present invention, the loop-forming means can form at least one loop in the intermediate medium, such loop extending along the image-transfer station and the transfer of a toner image to the strip of receiving material takes place from the leading edge of the toner image on the intermediate medium to the trailing edge of the toner image on the intermediate medium as considered in the direction of advancement of the intermediate medium. Consequently, the loop is formed in the area enclosed by the image-forming station and the image-transfer zone, resulting in a compact apparatus.

In a still further attractive embodiment, each of the loop-forming means comprises a roller guiding and tensioning the intermediate medium, such roller being movable in a path forming an acute angle with a plane in which the strip of receiving material is situated. Consequently, both loops are situated within the area enclosed by the image-transfer zone, and the angle between the intermediate medium and the plane containing the strip of receiving material remains the same at the image-transfer station. By making these acute angles equal to one another, the extreme positions of the intermediate medium are symmetrical with respect to the central position of the intermediate medium.

BRIEF DESCRIPTION OF THE DRAWINGS

The invention will be explained hereinafter with reference to the accompanying drawings wherein.

DETAILED DISCUSSION OF THE INVENTION

Figure 1:
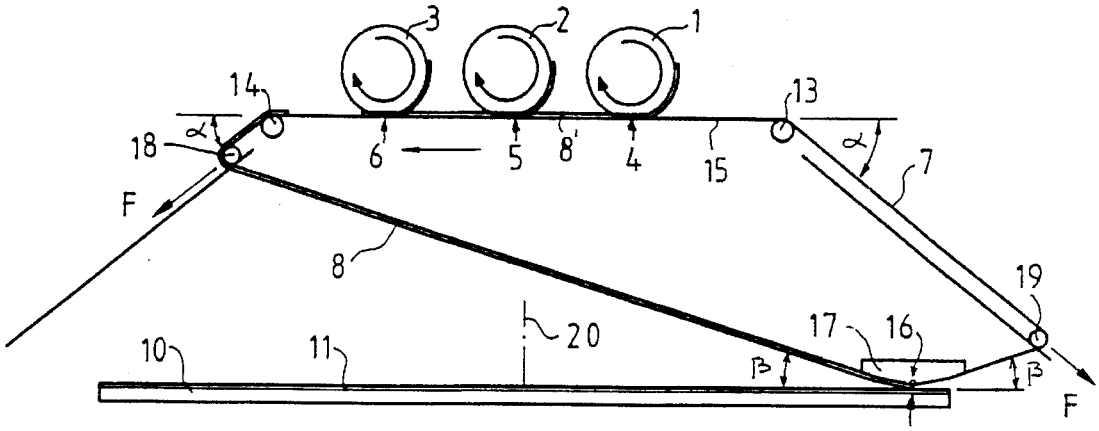
FIG. 1 is a diagram of an apparatus according to the present invention at the start of an image-transfer cycle.
Figure 2:
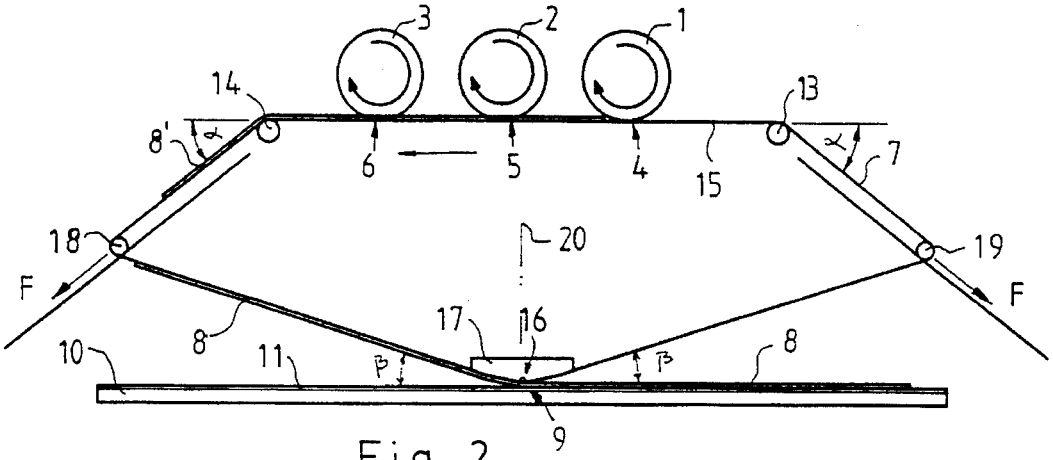
FIG. 2 shows the apparatus of FIG. 1 in the middle of an image-transfer cycle.
Figure 3:
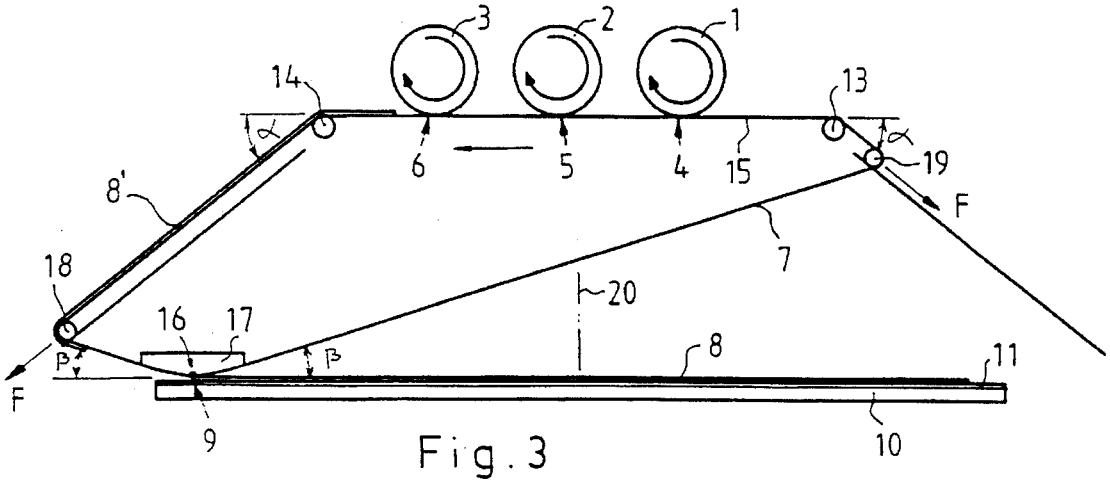
FIG. 3 shows the apparatus according to FIG. 1 at the end of an image-transfer cycle.

The apparatus shown in FIGS. 1 to 3 comprises image-forming drums 1, 2 and 3, e.g. of the kind described in European patent application 0595388, which are each disposed at a fixed position and which are in rolling contact with an endless belt 7 constituting an intermediate medium for image transfer at image-forming stations 4, 5 and 6. A toner sub-image, e.g. a color separation image in the case of a color image, can be formed in powder form by each of the drums 1, 2 and 3 and is deposited on the endless belt 7 at the associated image-forming station 4, 5 or 6, in order to form a multi-color image 8 when the toner layers are overlaid. The toner image 8 thus formed on the endless belt 7 moving continuously along the image-forming stations 4, 5 and 6 is transferred by rolling action at the image-transfer station 9 to a strip of receiving material 11 stationary on a table 10, as will be explained hereinafter. After transfer of the toner image 8 to a strip of receiving material 11, the latter is moved over the table 10 by a distance corresponding to the width of the strip, in a direction extending transversely to the direction of movement of the endless belt 7, in order to transfer a subsequent image 8' to an adjoining strip of receiving material, with toner image 8' adjoining toner image 8. Given a strip width of 300 mm and a strip length of 900 mm, it is thus possible to print a toner image of AO format in four parts on a AO receiving sheet.

The endless belt 7, functioning as an intermediate medium, is trained around two guide rollers 13 and 14 disposed at fixed positions on either side of that part 15 of the endless belt 7 which extends along the image-forming stations 4, 5 and 6. At image-transfer station 9 the endless belt 7 is trained around an image-transfer roller 16 mounted rotatably in a carriage 17 adapted to reciprocate in a direction parallel to the table 10. On movement of carriage 17 from the initial position shown in FIG. 1, through the intermediate position shown in FIG. 2, to the end position shown in FIG. 3, the image-transfer roller 16 moves the endless belt 7 in a rolling contact over the strip of receiving material 11 on the table 10, in order to transfer the toner image 8 to the strip. During the rolling movement of that part of the endless belt 7 which is trained around the image-transfer roller 16, the endless belt is kept taut by tensioning rollers 18 and 19. Tensioning roller 18 holds the endless belt 7 taut in that part of the belt which extends between the guide roller 14 and the moving image-transfer station 9 and tensioning roller 19 holds the endless belt 7 taut in that part of the belt which extends between the image-transfer station 9 and the guide roller 13. By the application of the tensioning forces, the tensioning rollers 18 and 19 are each movable in the direction denoted by arrows F in FIGS. 1 to 3 in a plane which forms an obtuse angle with that part of the belt 15 which passes through the image-forming stations 4, 5 and 6 and thus forms an acute angle α with the extension of that part of the belt 15. On movement of carriage 17 from the starting position shown in FIG. 1 in the direction of the positions shown in FIGS. 2 and 3, during which movement part of the endless belt rolls over the stationary strip of receiving material 11, the tensioning rollers 18 and 19 move from the positions shown in FIG. 1, through the intermediate position shown in FIG. 2, to the end position shown in FIG. 3, during which movement that part of the belt which extends between the image-transfer roller 16 and the tensioning roller 19 always includes an acute angle β with the plane of the table 10 and, also, that part of the belt which extends between the image-transfer roller 16 and the tensioning roller 18 always includes an acute angle β with the plane of the table 10, in order to keep the tension constant in those parts of the endless belt 7 which extend from the image-transfer roller 16.

In the middle position of the endless belt 7 shown in FIG. 2, the tensioning rollers 18 and 19 occupy positions which are symmetrical with respect to a plane 20 passing in the middle position through the image-transfer station 9 and perpendicular to the plane of the table 10. In the end position of the endless belt 7, shown in FIG. 3, the endless belt 7 occupies a position which with respect to plane 20 is a mirror image of the starting position of the endless belt 7 shown in FIG. 1.

Figure 4:
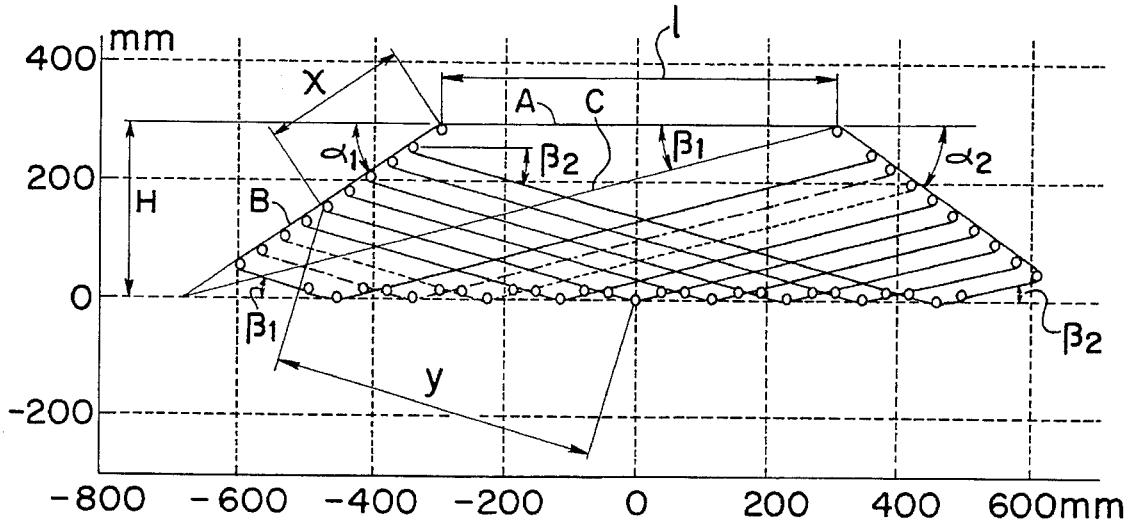
FIG. 4 shows the intermediate medium provided in the apparatus according to FIGS. 1 to 3, in a number of positions.

With a dimensionless image-transfer roller 16 and dimensionless tensioning rollers 18 and 19, in the end positions of the endless belt 7 shown in FIGS. 1 and 3, the then linear image-transfer roller 16 can coincide with the then linear tensioning rollers 19 and 18, respectively. As shown in FIG. 4, in that theoretical case the endless belt 7 may assume a triangular configuration with sides A, B and C, the plane in which the tensioning rollers 18 and 19 respectively move and the plane in which the image-transfer station moves passing through a corner point of the triangle. It is not possible to achieve this theoretically possible triangular belt configuration in practice, because the image-transfer roller 16 on the one hand, and the tensioning rollers 18 and 19 on the other hand, in view of their dimensions, cannot occupy the same position, but can serve to determine the relationship between the acute angles α and β. Given a length 1 of part A of the triangle extending in the image-forming plane and parallel to the image-transfer plane at a distance H therefrom, the total length L of the endless belt can be formulated as:

$$L = 1 + \frac{H}{\sin\beta} + \frac{H}{\sin\alpha} \tag{1}$$

From this it follows that:

$$\tan\alpha = \frac{H}{\frac{H}{\tan\beta} - 1} \tag{2}$$

In the middle position of the endless belt 7, tensioning rollers 18 and 19 are at a distance x from the end point of the fixed part A and at a distance y from the image-transfer station. The total length L of the endless belt can now be expressed as:

$$L = l + 2x + 2y \tag{3}$$

Substitution of (1) in (3) gives:

$$2(x+y) = \frac{H}{\sin\alpha} + \frac{H}{\sin\beta} \tag{4}$$

Also, since:

$$\tfrac{1}{2}l + x\cos\alpha = y\cos\beta \tag{5}$$

substitution of y from (5) in formula (4) gives:

$$x = \frac{H\sin\beta\cos\beta + H\sin\alpha\cos\beta - l\sin\alpha\sin\beta}{2\sin\alpha\sin\beta(\cos\alpha + \cos\beta)} \tag{6}$$

Given predetermined values of the distances l, H and the acute angles α and β, it can readily be deduced that the image-transfer stations are situated in a flat plane at a distance H from the image-forming stations.

Figure 5:
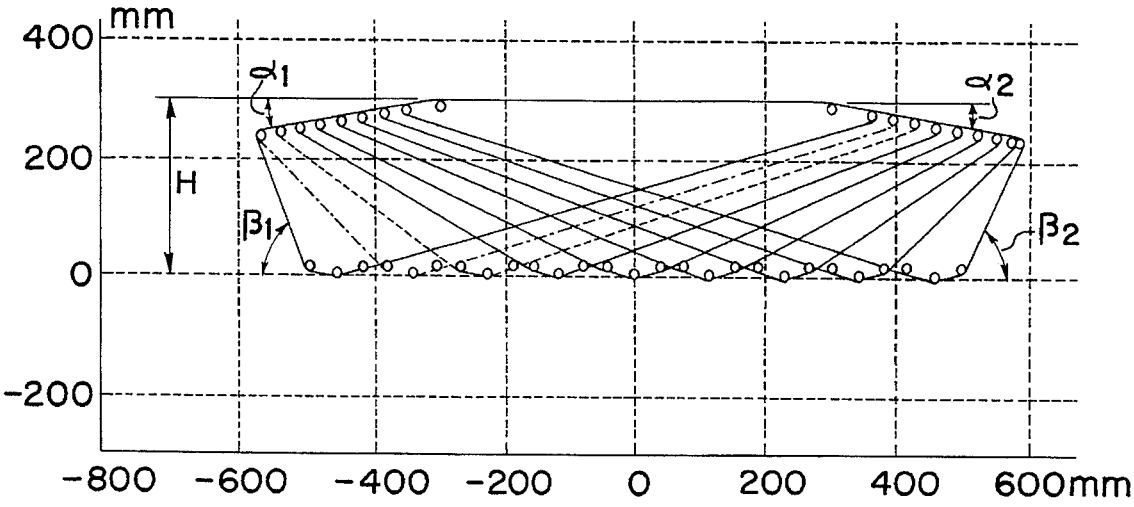
FIG. 5 shows an intermediate medium in a configuration differing from that shown in FIGS. 1 to 4.
Figure 6:
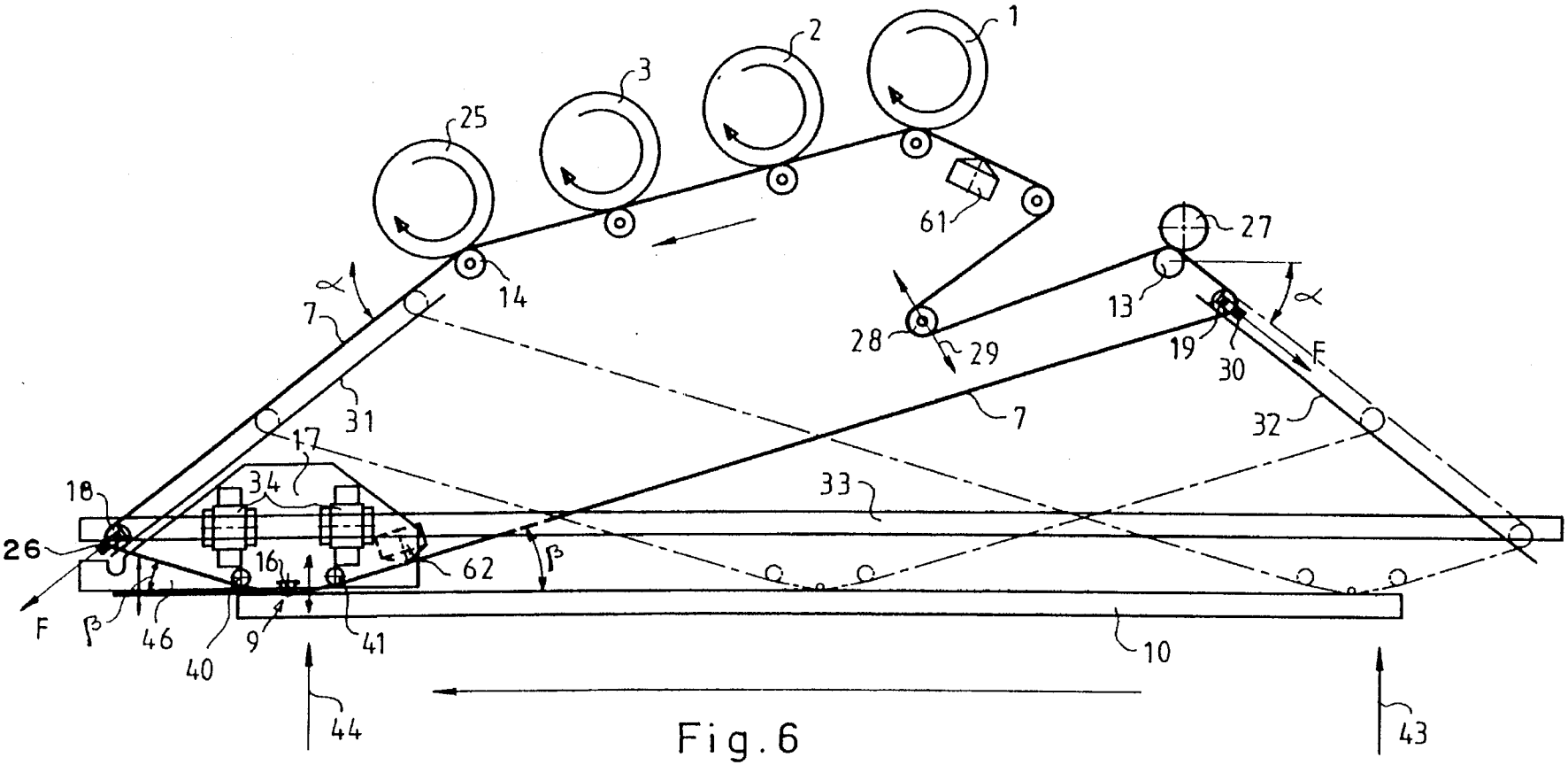
FIG. 6 is a side elevation of an embodiment of the apparatus shown in FIGS. 1 to 3.
Figure 7:
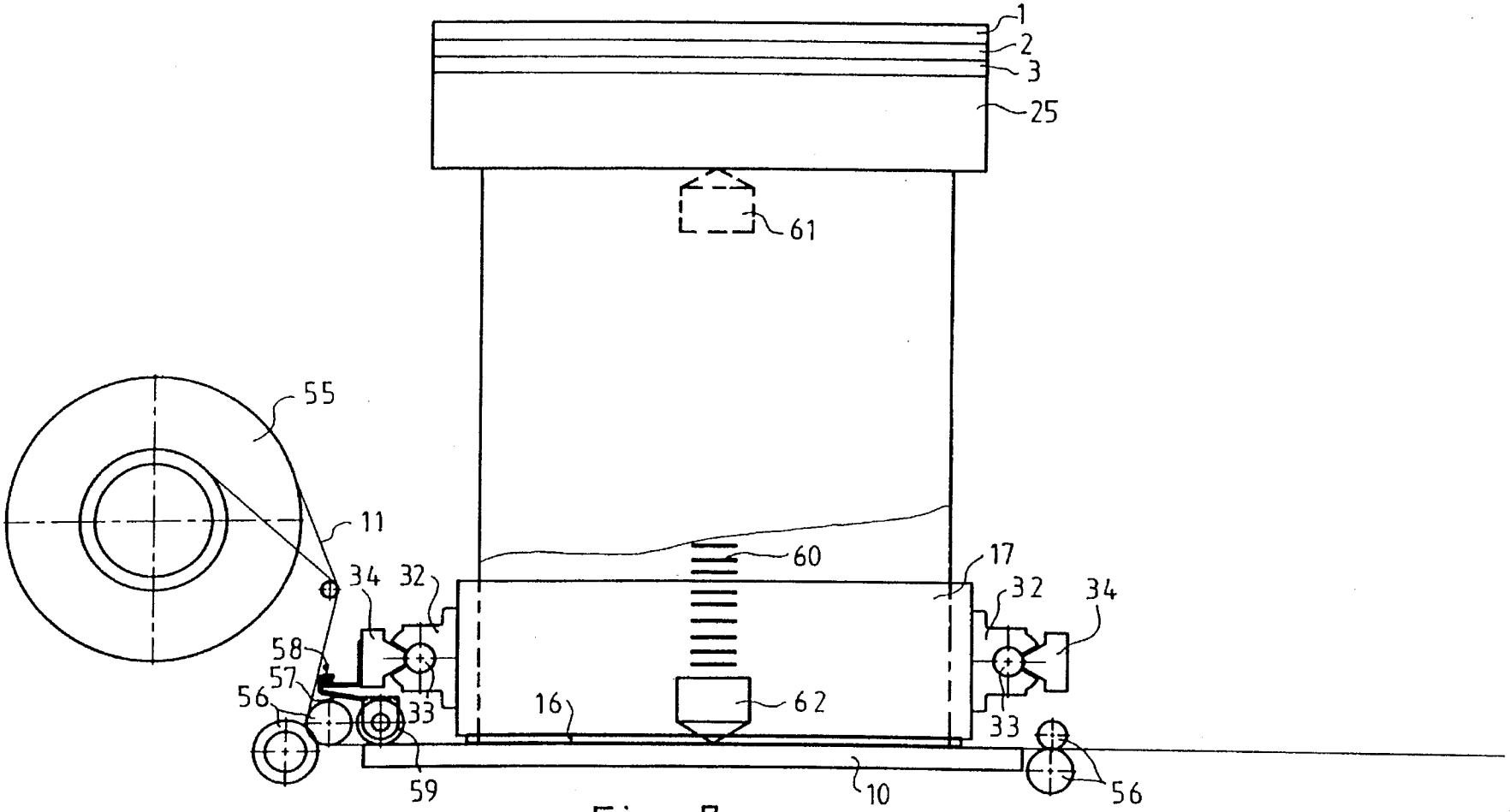
FIG. 7 is a front elevation of the embodiment according to FIG. 6.
Figure 8:
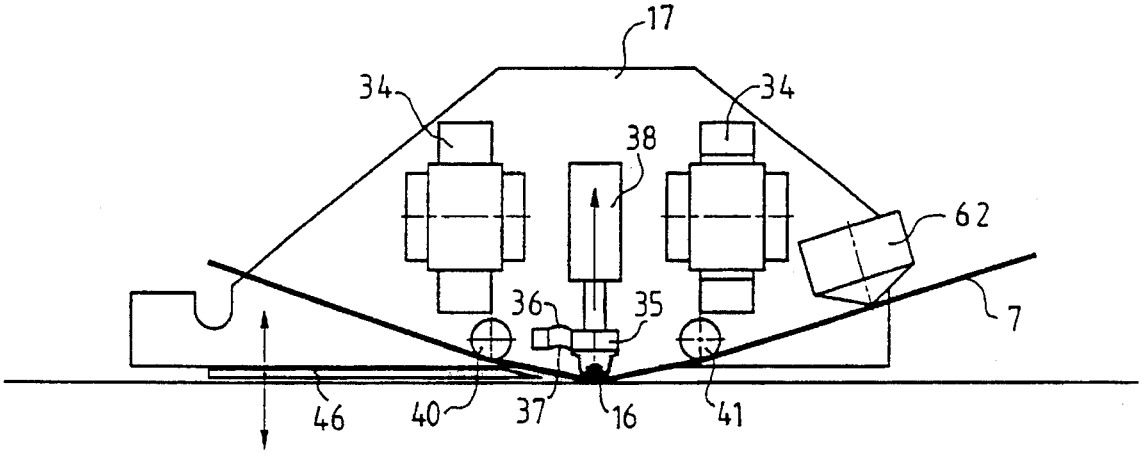
FIG. 8 is a detail of the embodiment shown in FIG. 6.
Figure 9:
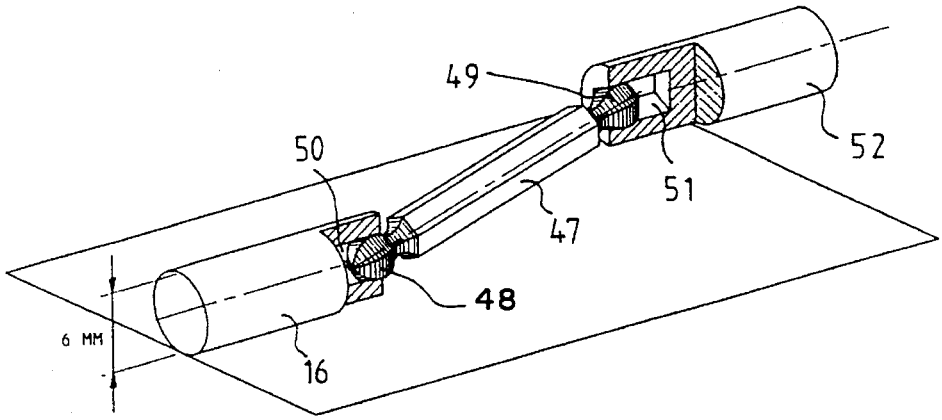
FIG. 9 is another detail of the embodiment shown in FIGS. 6 and 7.

To print an approximately 900 mm long strip of receiving material (shortest dimension of an AO format) and allowing for a length l of at least approximately 600 mm to locate at least three color image-forming units, and also allowing for not too small of a separating angle between belt 7 and receiving material 11 for good image transfer (minimum angle β approximately 15°), the preceding formulas give a value of approximately 35° minimum for an angle α. Since much larger values of the angles $\alpha$ and $\beta$ result in an unnecessarily large overall height H of the apparatus, suitable values for angle $\alpha$ are preferably in the range of between 35° and 40° and, for the angle $\beta$, in the range between 15° and 20°, and the relationship between angles $\alpha$ and $\beta$ given by formula (2) must, of course, still be satisfied. For comparison purposes, FIG. 5 shows a configuration of the endless belt 7 in which the angle $\alpha$ is smaller than the value arising out of formula (2). It will readily be seen that the value of the acute angles $\beta$ in these conditions is not constant, but varies with the instantaneous positions of the tensioning rollers, and this results in variable belt tensions on movement of the image-transfer point.

Because of the dimensions of the carriage 17 and tensioning rollers 18 and 19, the extreme positions of the carriage 17 with the image-transfer roller 16 will be distanced from the theoretically possible end positions. Also, in order to ensure that the angle $\beta$ remains constant, i.e., is independent of the position of the carriage 17, the relationship between the angles $\alpha$ and $\beta$ must take into account the arc circumscribed by the endless belt 7 around the associated rollers. By means of a computer model prepared for the configuration of the endless belt 7 shown in FIGS. 4 and 5, where $\alpha_1=\alpha_2$, iterative values for the angle $\alpha$ are determined and the variance of the angle $\beta_1$ and $\beta_2$ resulting at a given angle $\alpha$ is calculated for the various carriage positions. FIG. 5 shows a situation with a relatively small angle $\alpha_1=\alpha_2$, the calculated variance of the angles $\beta_1$ and $\beta_2$ being large, while FIG. 4 shows the optimal situation for which the variance of the angle $\beta_1$ and $\beta_2$ is minimal for a larger angle $\alpha_1=\alpha_2$. According to the invention, it is not strictly necessary for $\alpha_1$ to equal $\alpha_2$. By means of an adapted computer model it is possible to determine a value for the angle $\alpha_1$ at which the variance of the angle $\beta_1$ is minimal and, apart from this, a value for angle $\alpha_2$ at which the variance of the angle $\beta_2$ is minimal. Given optimal geometry of the endless belt 7 as shown in FIG. 4, with angles $\alpha$ and $\beta$ which are constant irrespective of the position of the carriage 17, and with the application of constant tensioning forces F to the tensioning rollers, the tensions in the taut endless belt 7 remain constant during reciprocation of the carriage 17. The latter is favorable for exact superimposition of sub-images on a continuously advancing part of the endless belt 7 and also for good transfer of a toner image to the stationary receiving material at the translatory image-transfer roller 16.

The operation of the apparatus shown in FIGS. 1 to 4 is as follows. In the active state of the apparatus, the 2200 mm long endless belt 7 moves continuously at a speed of 6 m/min along the image-transfer drums 1, 2 and 3 to form toner images 8 and 8' on the belt 7. The distance H between the image forming plane and the image-transfer plane is 500 mm. In the starting position for transferring the first toner image 8 to a receiving material 11, the endless belt 7 is in the position shown in FIG. 1. In this position, the image-transfer roller 16 which is initially free from the receiving material 11 is brought into contact therewith the carriage 17 is moved over a distance of approximately 900 mm to its other extreme position at a speed of 10 m/min, in order to transfer and fix the toner image on a strip of receiving material 11 under the influence of heat and pressure. During this translatory movement, tensioning roller 18 moves down obliquely at an angle $\alpha$ to form a loop or section in the endless belt 7 between the image-forming station 6 and the image-transfer station 9 and tensioning roller 19 moves obliquely upwards at an angle $\alpha$ to remove a loop or section initially present in the endless belt 7 between the image-transfer station 9 and the image-forming station 4, until the situation shown in FIG. 3 is reached. The next toner image 8' formed on the endless belt 7 is situated on the loop in front of the image-transfer station 9. The carriage 17 is now returned in an accelerated manner to the position shown in FIG. 1, during which movement the image-transfer roller 16 is lifted from the receiving material 11 and the latter is moved over a distance corresponding to the width of the endless belt 7 in a direction extending transversely to the direction of movement of the belt 7. In the resulting situation, the next toner image 8' occupies the position shown in FIG. 1 with respect to the previous toner image 8 and the image transfer for the next image 8' starts, this next image being printed on the receiving material 11 so as to adjoin toner image 8.

Within the scope of the invention it is also possible to form one or both loops outside the area enclosed by the image-forming and image-transfer stations. As a result, it is possible to embody an apparatus in which the distance between the image-forming station or stations and the image-transfer station is small, but at the expense of a greater distance being required in the direction in which the loops have to be formed.

FIGS. 6 to 9 show one embodiment of an apparatus according to the present invention. Parts of the embodiment shown in FIGS. 6 to 9, which correspond to the apparatus shown in FIGS. 1 to 3, have like references. The endless belt 7 is constructed as a dimensionally stable fabric band covered with a layer of rubber, e.g. Neoprene or EPDM rubber, on both sides, and provided with a silicone rubber top layer at the outside for transferring, under the influence of pressure and heat, to receiving material toner images formed next to or on top of one another on the belt 7 by image-forming units 1, 2, 3 and 25. Toner not transferred at the image-transfer station 9 is removed from the belt 7 by a cleaning roller 27 before a new toner image is applied to the belt 7. The latter is driven by a drive roller 28 and forms a circumscribed arc of about 180° therewith for slip-free belt transport. The drive roller 28 is tiltable in a direction denoted by arrow 29 to correct any skew of the belt, without introducing any appreciable tension in the belt at the image-forming and image-transfer stations. Belt movement without excessive skewing is important to enable image strips properly adjoining one another, i.e. without forming any overlap or gap, to be printed consecutively on receiving material transversely to the direction of movement of the belt.

The rocking tensioning rollers 18 and 19 which keep the endless belt taut during translatory movement of the image-transfer station 9 have at the ends fixing lugs 29 and 30 for tensioning wires (not shown, which pull the tensioning rollers 18 and 19 in the directions denoted by arrows F, such directions being parallel to the rectilinear guides 31 and 32 respectively for the tensioning rollers 18 and 19. The carriage 17 to form the translatory image-transfer station 9 has on either side bearing blocks 32, shown in FIG. 7, extending over rods 33 fixed to the frame of the apparatus. The rods 33 are kept in position by supports 34 which press against the sides of the rod remote from one another. The carriage 17 carries a thin image-transfer roller 16 to form a narrow transfer nip between the endless belt 7 and the receiving material on a flat table 10. The image transfer roller 16 is mounted in an elongate block 35 shown in FIG. 8, which is provided with a Teflon-covered channel to support the image-transfer roller 16. The block 35 with the image-transfer roller 16 contained therein is secured to the carriage 17 by two parallel leaf springs 36 and 37, which press the image-transfer roller 16 into a position in which the transfer nip is formed. An actuator 38 can bring the block 35 against the action of leaf springs 36 and 37 into a position in which the nip is formed. In this latter position, the tensioning rollers 18 and 19 hold the endless belt 7 in contact with the image-transfer roller 16 and, hence, keep it free from the receiving material 11 on the flat plate 10. Belt guide rollers 40 and 41 are mounted in the carriage 17 on either side of the image-transfer roller 16. Rollers 40 and 41 ensure that the belt parts between the rollers always form exactly the same angle with the flat plate 10, so that the transfer nip is not affected by the angle variation, even though minimal, which may occur in the parts of the belt which run from the carriage 17 to the tensioning rollers 18 and 19, such angle variation occurring on translation of the carriage 17. On translation of the carriage 17 with the transfer nip formed, from the initial position denoted by arrow 43 to the end position denoted by arrow 44, a toner image is transferred under the influence of pressure and heat from the endless belt 7 to a receiving material and fixed thereon. The heat required for this purpose is supplied to the receiving material just before the toner is transferred thereto. For this purpose, a heating element 46 is fixed to the carriage 17 and extends in the wedge-shaped area between the flat plate 10 and the endless belt 7. The heating element 46 consists of a 4 mm thick aluminum plate provided with a heating foil and a non-stick layer on the underside. The heating element extends close to the transfer nip, e.g. to a distance of 15 mm therefrom. During an image-transfer cycle, the heating element 46 is pressed by leaf springs (not shown) against the receiving material in order to heat the receiving material after the style of an iron, for example, to a temperature of 80° C. During the inoperative movement of the carriage 17, an actuator (not shown) keeps the heating element, against spring action, at a short distance from the flat plate 10, e.g. 2 mm, in order to avoid interaction with a toner image already transferred. The narrow transfer nip formed by the thin image-transfer roller 16 (a nip width of about 1 mm in the case of a roller of 6 mm in diameter) results in relatively little heat transfer via the nip and a relatively small pressure application force is required. In order to avoid tangential forces being applied in the transfer nip, the frictional forces experienced by the image-transfer roller 16 and the guide rollers 40 and 41 are compensated by slightly driving these rollers. Since the thin image-transfer roller 16 is situated just above the flat plate 10 and the drive must follow an upward movement of the roller, the drive is connected to the image-transfer roller 16 via a universal joint shown in FIG. 9. The universal joint comprises a hexagonal bar 47 with rounded ends 48 and 49 which respectively fit in a hexagonal hole 50 in the image-transfer roller 16 and a hexagonal hole 51 in the drive shaft 52. Because of the axial play in the hexagonal holes 50 and 51, the image-transfer roller 16 does not experience any drive component in the axial direction which might influence the running of the belt. The drive for the guide rollers 40 and 41 in the carriage 17 is of importance particularly in forming the transfer nip. At the time that the belt 7 begins to touch the stationary receiving material, the belt speed must be 0. Driving the rollers prevents any obstruction from the frictional forces exerted on the belt by the rollers, so that the belt position and belt speed are controllable at the image-transfer station 9. The presence of tangential forces in the transfer nip is further avoided, as already stated, by the constant angles β during the translation of the carriage 17, so that the tensile forces in the belt 7 are independent of the carriage position.

The receiving material 11 for printing is fed from a supply roller 55 and fed over the flat plate 10 by a driven pair of rollers 56. To keep receiving material flat on the flat plate 10 during translation of the carriage 17 with the transfer nip closed, the plate is in the form of a 4 mm thick mirror glass sheet on which a track pattern is applied and is covered by a thin wear-resistant layer. The track pattern is connected to a high voltage in order to draw the receiving material 11 against the glass plate 10 by electrostatic forces. Consequently, the receiving material 11 heated by heating element 46 remains flat during the contact image transfer and does not bulge before the translatory transfer nip, which might involve creasing. Periodic transport of the receiving material to position a following strip of receiving material on the glass plate 10 should take place exactly in order to avoid any register faults between the image strips. For this purpose, a long arm 57 is provided which at one end is secured by a spherical hinge 58 to the frame of the apparatus and which at the other end carries two parallel measuring wheels 59 with a pulse disc on the wheel shaft. The free mobility of the wheels 59 around the spherical hinge 58 means that they do not influence the transport of receiving material 11 over the glass plate 10. By pulse counting it is possible to control the transport of receiving material exactly over the width of a strip in order to avoid register errors in printing the image strips. For good register of the image strips in a direction corresponding to the direction of movement of the endless belt 7, it is important that the formation of the transfer nip and the start of the movement of the carriage 17 should be synchronized with the position of a toner image present on the endless belt. For this purpose, markings 60 are provided on the inside of the endless belt 7 at regular intervals, a number of these being shown in FIG. 7, and sensors 61 and 62 are provided for detecting these markings, sensor 61 as considered in the direction of the movement of the belt being disposed at a short distance in front of the image-forming stations and sensor 62 on carriage 17 at a short distance after the image-transfer station 9. On detection of a specific marking by sensor 61 an image-forming cycle starts with the application of a toner image, e.g. the image-forming drum 1, and the carriage is brought into the starting position for image transfer (the furthest right carriage position in FIG. 6). On detection of the same marking by sensor 62 the transfer nip is closed and the movement of the carriage started. Depending on the width of the receiving material supplied and the associated length of an image strip, the end position of the carriage is variable. The carriage stops when the image strip has been transferred, whereupon the image-transfer roller 16 and the heating element 46 are lifted from the receiving material 11 and the carriage 17 returns in an accelerated manner to its initial position for a following image-transfer cycle.

The image-transfer station 9 embodied in the apparatus, described before as a station combining transferring and fixing a toner image under influence of heat and pressure can, within the scope of the invention, also be embodied as a separate station for transferring a toner image from the endless intermediate medium to the stationary image receiving material under influence of an electrostatic force (which can be generated by a corona discharge) and a separate station for fixing the transferred toner image onto the image receiving material after that transfer in any convenient manner, e.g., as disclosed in U.S. Pat. No. 4,845,519.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. An imaging system comprising at least one image forming medium for transferring toner images, an endless intermediate medium adapted to be advanced in one direction, to which said toner images are to be transferred, at least one image-forming station corresponding to each of said at least one image-forming medium provided where said at least one image-forming medium contacts said endless intermediate medium, said endless intermediate medium being continuously movable at said at least one image-forming station, stationary image receiving material, an image-transfer station at which said toner images on said endless intermediate medium are transferred to said stationary image receiving material, and a first loop-forming means provided between said at least one image-forming station and said image-transfer station and a second loop forming means provided between said image-transfer station and said at least one image-forming station, as considered in the direction of advance of said endless intermediate medium, for periodically enabling stoppage of the advancement of said endless intermediate medium at said image-transfer station.

2. An imaging system according to claim 1, characterized in that said first and second loop-forming means form at least one loop in said intermediate medium, said loop extending along said image-transfer station and wherein transfer of a toner image to said stationary receiving material takes place from a leading edge of said toner image on the intermediate medium to a trailing edge of said toner image on said intermediate medium as considered in the direction of advancement of said intermediate medium.

3. An imaging system according to claim 2, characterized in that each of said first and second loop-forming means comprises a roller for guiding and tensioning said endless intermediate medium, said rollers being movable in a path forming acute angles $\alpha$ with a plane in which said stationary image receiving material is situated.

4. An imaging system according to claim 3, wherein said acute angles $\alpha$ are equal to one another.

5. An imaging system according to claims 3 or 4, characterized in that said acute angle $\alpha$ has a value in the range between 35° and 40°.

6. An imaging system according to claims 2 or 3, wherein said at least one image-forming station extends over a distance l, parallel to said plane in which said stationary image receiving material is situated and at a distance H therefrom, characterized in that said acute angles $\alpha$ satisfy the formula:

$$\tan\alpha = \frac{H}{H/\tan\beta - 1}$$

where $\beta$ is the angle included between said endless intermediate medium and said plane in which said stationary image receiving material is situated.

7. An imaging system according to claim 6, characterized in that said acute angle $\alpha$ has a value in the range between 35° and 40°.

8. An imaging system according to claim 6, characterized in that said acute angle $\beta$ has a value in the range between 15° and 20°.

9. A system according to claim 2, further including a thin pressure roller provided to press said endless intermediate medium against said stationary image receiving material at said image-transfer station for the purpose of transferring said toner images.

10. A system according to claim 9, wherein said pressure roller has a diameter of approximately 6 mm.

11. A system according to claim 10, wherein said pressure roller is mounted in a channel covered with a low-friction material.

12. A system according to claim 11, wherein a drive for said pressure roller comprises a coupling with a hexagonal shaft with rounded ends respectively fitting into a hexagonal hole formed in a drive shaft and a hexagonal hole formed in said pressure roller.

13. A system according to claim 2, further including a heating element provided to heat said stationary receiving material just before said image-transfer station moves for the purpose of transferring a toner image under the influence of heat.

14. A system according to claim 1, further including a flat plate forming said image-transfer station, which has a pattern of electrodes connectable to a voltage for the purpose of holding said receiving material stationary during image transfer.

* * * * *